United States Patent [19]

Kaufmann

[11] Patent Number: 4,492,174

[45] Date of Patent: Jan. 8, 1985

[54] THREAD CONTROL MECHANISM FOR SEWING MACHINES

[75] Inventor: Juergen Kaufmann, Mount Prospect, Ill.

[73] Assignee: Union Special Corporation, Chicago, Ill.

[21] Appl. No.: 467,003

[22] Filed: Feb. 16, 1983

[51] Int. Cl.[3] ..... D05B 57/00

[52] U.S. Cl. ..... 112/248; 112/241; 112/DIG. 3

[58] Field of Search ..... 112/DIG. 2, DIG. 3, 112/58, 165, 199, 241, 248, 255

[56] References Cited

U.S. PATENT DOCUMENTS

| | | | |
|---|---|---|---|
| 1,273,157 | 7/1918 | DeVoe | 112/241 |
| 2,157,373 | 5/1939 | Weis | 112/241 X |
| 3,565,027 | 2/1971 | Miller et al. | 112/255 |
| 4,325,314 | 4/1982 | Niem | 112/199 |

FOREIGN PATENT DOCUMENTS

| | | | |
|---|---|---|---|
| 2745976 | 4/1979 | Fed. Rep. of Germany | 112/DIG. 3 |
| 2745977 | 4/1979 | Fed. Rep. of Germany | 112/DIG. 3 |
| 2913746 | 10/1980 | Fed. Rep. of Germany | 112/165 |
| 2068149 | 8/1981 | United Kingdom | 112/241 |

*Primary Examiner*—Wm. Carter Reynolds

*Attorney, Agent, or Firm*—John W. Harbst; John A. Schaerli

[57] ABSTRACT

A pneumatic apparatus used in combination with a sewing machine thread take-up mechanism. The apparatus includes a device for directing a stream of air away from the machine's operating components and against the thread passing over the take up mechanism for preventing broken ends or loose thread from becoming entangled with the machine's operating components.

1 Claim, 3 Drawing Figures

THREAD CONTROL MECHANISM FOR SEWING MACHINES

FIELD OF THE INVENTION

This invention relates, in general, to new and useful improvements in sewing machines and, more particularly, to a thread control mechanism for chainstitch sewing machines.

BACKGROUND OF THE INVENTION

Thread control in sewing machines is a very important consideration in the formation of a good stitch. In sewing machines employing oscillatory rocking loopers, a rotary thread take up mechanism is usually employed to manipulate the looper thread as demanded by the oscillatory, lengthwise movement of the looper. While the looper is moving toward the needle, the take up mechanism allows a certain degree of slack in the thread system to allow the previously formed stitch to be properly set. During the return movement of the looper, and once all the slack has been removed from the system, the take up mechanism is effective to pull or draw thread from the cone or supply source. Prior to the time the looper returns to its initial position, the looper thread will be "cast off" the high point of the looper thread take up cam. After the thread has been cast off from the thread take up cam, still further thread is delivered into the system between the take up cam and the looper because of the continuing return motion of the looper. It should be noted, the required amount of looper thread for the next stitch was also drawn into the system before the thread was cast off the high point of the take up cam.

When the looper thread breaks or becomes excessively loose, rotary thread take ups, particularly those of double disc design, tend to wind thread around and about the mechanism's operating shaft. Understandably, excessive thread wind up about the operating shaft will eventually inhibit machine operation. Thus, varying styles of thread break mechanisms have been designed to eliminate such problems.

U.S. Pat. No. 4,325,314 is but one example of a mechanism adapted to prevent looper thread wind up about an operating shaft. But even this latest technological development has certain drawbacks. The apparatus disclosed in U.S. Pat. No. 4,325,314 intermittently pinches the looper thread at a point between the looper thread take up mechanism and the thread supply source. The operation of this apparatus is such that should looper thread entanglement occur, this mechanism cuts off the supply of thread from the thread source whereby preventing excessive thread usuage and wind up about the operating shaft. This same device, however, has the disadvantage of drawing additional unwanted looper thread during the stitch forming cycle. The provision of such an apparatus also requires the looper thread to pass through yet another thread handling instrumentality. The problematical thread handling effects of such an arrangement are apparent. Moreover, such a mechanism is not effective during the entirety of the stitch forming cycle. As mentioned, such device is only intermittently operated. Even with the patented apparatus, a small portion of looper thread will become wound about the operating shaft before the thread breaks. Eventually, these thread pieces will windingly accumulate about the shaft. Before the machine is returned to operation, this wound thread must be removed from the shaft to enable use of the machine. In many machines, the thread take up area is inaccessible. Thus, the problem of removing the wound thread from about the rotary shaft is a timely and costly process.

The present invention involves a thread control mechanism which has the advantage of preventing thread from becoming wound about the operative mechanism of the machine. To accomplish these ends, the present invention includes a pneumatic apparatus which is arranged in combination with the thread take up mechanism and is operated coincident with operation of the machine for preventing excessive or broken ends of thread from becoming entangled with the operative mechanism of the machine. More particularly, the present invention includes means for directing a fluid medium against the looper thread and in a direction away from the operative components of the machine whereby excessive thread or thread ends are displaced from the operative environment of the machine. Thus, excessive thread wind up about an operative shaft is eliminated.

In line with all of the above, it is the primary object of this invention to provide suitable means which will prevent thread from spooling up about the thread take up mechanism of the machine.

It is another object of this invention to provide a thread control mechanism which is relatively simple in construction, dependable in operation, and is suited for use in connection with industrial sewing machines.

Yet another object of this invention is to provide a thread control mechanism which is versatile for use with machines regardless of the degree of looper travel.

BRIEF DESCRIPTION OF THE DRAWINGS

Having in mind the above objects and other attendent advantages that would be evident from an understanding of this disclosure, the invention comprises the devices, combinations and arrangement of parts as illustrated in the presently preferred embodiment of the invention which is hereinafter set forth in detail to enable those skilled in the art to readily understand the functions, operation, construction and advantages of it when read in conjunction with the accompanying drawings in which.

DETAILED DESCRIPTION OF THE PRESENT INVENTION

Figure 1:
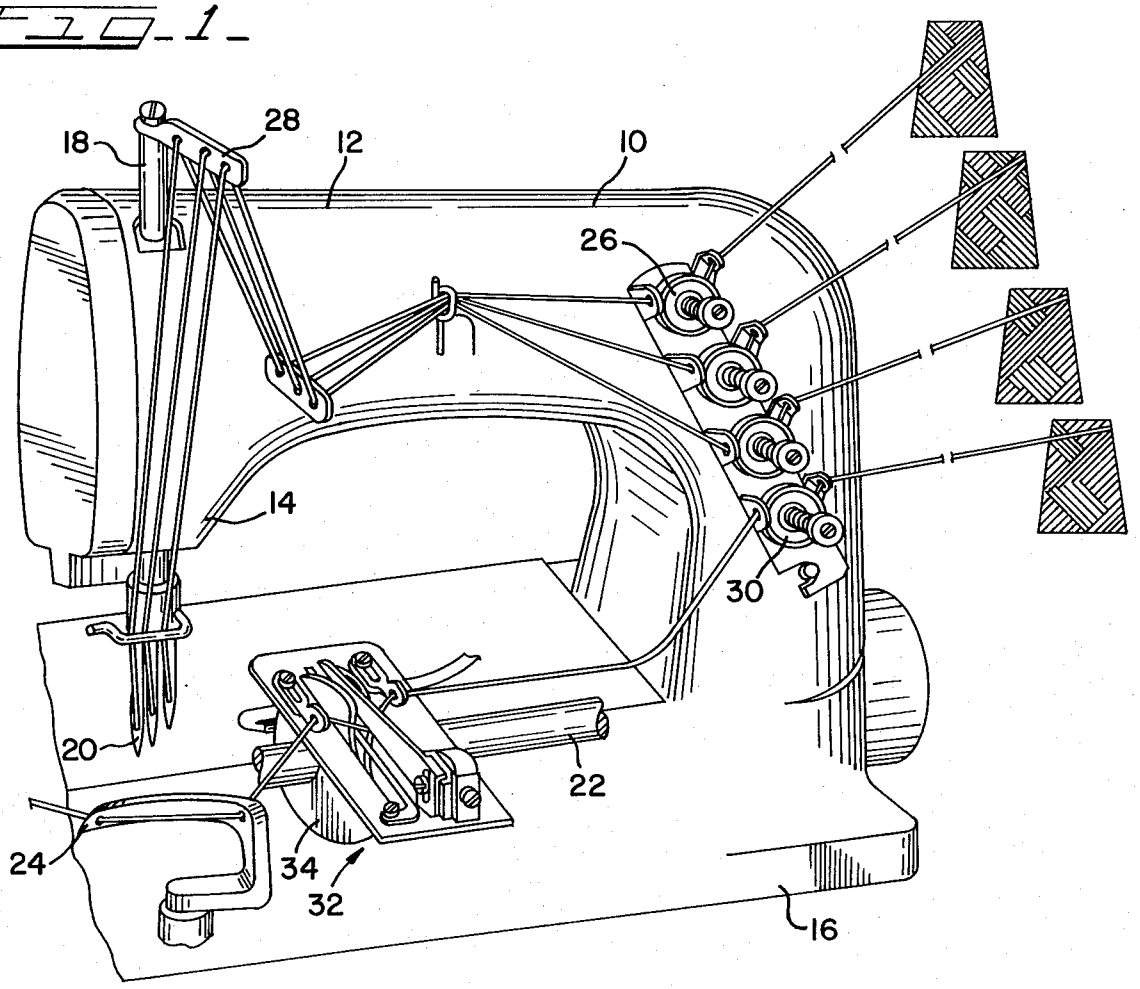
FIG. 1 is a schematic showing of a sewing machine illustrating the present invention.
Figure 3:
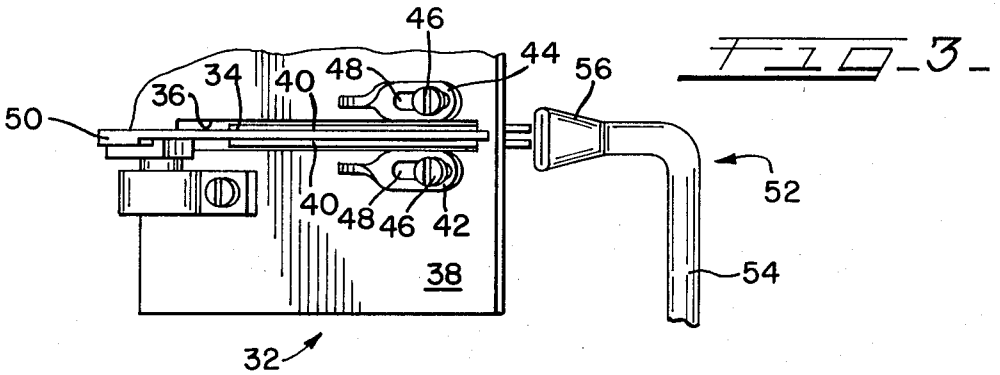
FIG. 3 is a partial top plan view of the present invention.

Referring now to the drawings, wherein like reference numerals indicate like parts throughout the several views, only so much of the sewing machine is shown as deemed necessary to illustrate the application and mode of operation of a presently preferred embodiment of the invention. The sewing machine in which the present invention is embodied is a chainstitch sewing machine including a series of mechanisms for timely actuating suitable stitch forming devices to concatenate one or more threads into a series of stitches. Although the present invention is illustrated for use with a lower stitch forming instrumentality, it will be appreciated that its operating principle is equally applicable to other stitch forming devices.

As shown in FIG. 1, the sewing machine 10 is provided with a frame 12 having a bracket arm 14, the free end of which overhangs a lower machine bed 16. In the usual manner, a needle bar 18 is arranged for endwise reciprocation in the free end of bracket arm 14. At its distal end, the needle bar is adapted to carry one or more thread carrying needle means 20. Journaled in suitable bearing bushings (not shown) arranged in the sewing machine bed 16 is a rotary shaft 22 which is adapted to drive a looper means 24. For purposes of clarity, the needle and looper actuating mechanisms have not been shown, albeit any suitable, well known mechanisms would suffice. The looper means of the machine preferably partakes of oscillation lengthwise or endwise of the looper for seizing and shedding the needle thread loops as well as oscillation sidewise to partake of needle avoiding movement.

The threads for the needle means 20 run from a thread supply source through suitable thread tensioning elements 26 and thread eyelets 28 and ultimately to the needle means. Likewise, the looper thread passes from a thread supply source through a suitable thread tensioning apparatus 30 and is delivered to the looper means 24.

The machine is further provided with a thread take up mechanism 32 which operates as a function of the looper's reciprocatory position so as to control the amount of thread arranged between the looper means 24 and the looper thread supply. To accomplish this end, the thread take-up mechanism includes operative components for guiding and applying tension to the looper thread as the looper starts toward said needle means and acts throughout most of the looper's means movement toward said needle means. More particularly, the thread take up mechanism includes a thread cam 34 adjustably mounted upon the shaft 22 and which projects upwardly through a suitably sized elongated opening or slot 36 provided in a carrier or support plate 38. The support plate 38 may be pivotally secured to the machine bed in an overhanging relationship to the shaft 22 by any suitable means. Preferably, the thread cam is formed of two equally shaped, spaced discs 40. The support plate 38 is further adapted to carry two thread guides 42 and 44 positioned respectfully on opposite sides of the opening 36 but closely adjacent thread cams so that the thread will be guided or passed laterally across the opening 36. Each of the thread guides is secured to the plate 38 by means of a fastener 46 received in a slot 48 to permit adjustment of said thread guides with respect to the cam axis. A thread stripping finger 50 is also adjustably carried by the support plate 38. In operation, the revolution of the shaft 22 causes reciprocal looper movement and also results in turning movement of the cams or discs 40 which combine with the eyelets 42 and 44 to manipulate the thread passing thereover and therethrough to take up thread slack as a function of the looper's reciprocatory position. The stripping finger 50 is centered between the two discs for the purpose of controlling, in a well known manner, the looper thread.

Figure 2:
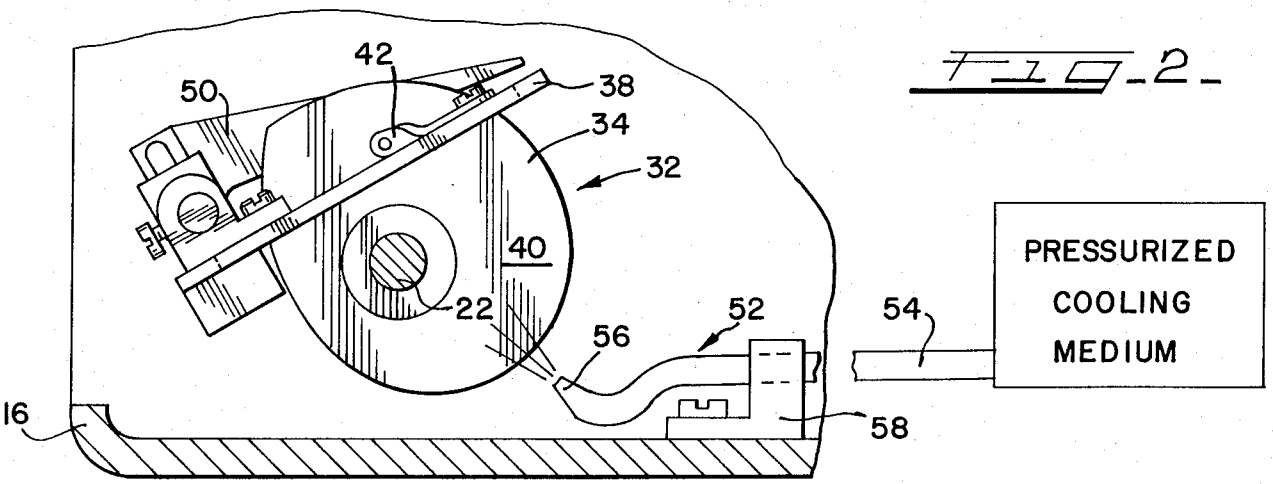
FIG. 2 is an enlarged side sectional view illustrating the present invention.

The present invention further provides continuously operative means for preventing the broken ends or loose looper thread from becoming entangled with the rotary shaft whereby eliminating excessive thread wrap up about said shaft. The apparatus for accomplishing this result includes a pneumatically operated means 52 disposed proximate the thread take up mechanism for preventing looper thread from becoming entangled with the shaft or cam means. More particularly, the pneumatic means includes a supply conduit 54 having a nozzle 56 fixed to one end thereof. The other end of the conduit 54 is connected to a pressurized fluid medium, such as air. The nozzle 56 is adapted to direct therefrom a pneumatic jet of air of sufficient force and velocity through the opening 36 between the thread guiding members and about the cam surfaces 40 in a direction away from the shaft 22 to prevent the loose or broken ends of looper thread from becoming entangled with said shaft. As will be apparent from FIG. 2, to achieve these results, the nozzle 56 is directed toward the looper thread handling mechanism and is mounted and maintained in its properly directed position by any suitable and desirable bracket or mounting means 58.

The supply of air to the nozzle is preferably timed to be coincident only with machine operation. In this manner, a continuous stream of air will be directed against the thread during the entirety of the sewing operation or cycle. If, for any reason, the looper thread should break, the pneumatic means of the present invention will displace the broken or excessive thread away from the machine's operating components thus eliminating excessive thread wind up and usage.

Thus it is apparent that there has been provided, in accordance with the invention a Thread Control Mechanism for Sewing Machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. A cam thread pulling device for a looper thread of a sewing machine comprising:

a cam operatively driven by a rotating shaft;

a plate member including means defining an elongated opening through which said cam may extend and including thread guiding means thereon to direct thread in a direction substantially laterally across said elongated opening; and means for directing a flow of air through said elongated opening and against the looper thread whereby preventing a free end of looper thread from becoming entangled with said rotary shaft.

* * * * *